US005199344A

United States Patent [19]

Wagner et al.

[11] Patent Number: 5,199,344

[45] Date of Patent: Apr. 6, 1993

[54] LOCK CYLINDER FOR BACKHOE SLIDE FRAME

[75] Inventors: Oryn B. Wagner; Knute K. Brock, both of Bismarck, N. Dak.

[73] Assignee: Clark Equipment Company, South Bend, Ind.

[21] Appl. No.: 713,714

[22] Filed: Jun. 11, 1991

[51] Int. Cl.[5] ..... F15B 15/26; B66C 23/00

[52] U.S. Cl. ..... 92/28; 92/75; 91/41; 414/695; 188/41

[58] Field of Search ..... 92/28, 75, 50; 188/41, 188/43, 38, 67, 151 R; 414/695; 91/41

[56] References Cited

U.S. PATENT DOCUMENTS

| | | | |
|---|---|---|---|
| Re. 26,439 | 8/1968 | Long | 280/456 |
| 3,212,732 | 10/1965 | Scerbo et al. | 92/28 |
| 3,405,823 | 10/1968 | Williams | 214/138 |
| 3,441,263 | 4/1969 | Burritt | 267/1 |
| 3,500,725 | 3/1970 | Haddock, Jr. | 92/75 |
| 3,608,930 | 9/1971 | Moriceau et al. | 280/456 |
| 3,858,485 | 1/1975 | Rosaen et al. | 91/436 |
| 3,877,349 | 4/1975 | Schindel | 92/53 |
| 3,891,065 | 6/1975 | Iijima et al. | 188/41 |
| 3,945,300 | 3/1976 | Bourges | 91/173 |
| 4,046,346 | 9/1977 | Iijima et al. | 248/298 |
| 4,140,232 | 2/1979 | Myers et al. | 414/695 |
| 4,363,260 | 12/1982 | Sakai | 92/13 |
| 4,741,663 | 5/1988 | Kennedy | 414/695.5 |
| 4,921,392 | 5/1990 | Wagner | 414/695 |

FOREIGN PATENT DOCUMENTS

| | | |
|---|---|---|
| 1542712 | 9/1968 | France . |
| 61-87032 | 5/1986 | Japan . |

OTHER PUBLICATIONS

JP 61-87032 (A) Abstract, Feb. 1986.

*Primary Examiner*—Edward K. Look
*Assistant Examiner*—Hoang Nguyen
*Attorney, Agent, or Firm*—Kinney & Lange

[57] ABSTRACT

A lock cylinder for a backhoe slide frame which provides for a positive lock of the slide frame in selected positions is described. The slide frame is supported on two generally horizontal rails that are vertically spaced, and the lock cylinders mount between the vertically spaced rails. The lock cylinders each have a piston that acts to hold the slide frame seated against the upper one of the rails. The piston also provides a wedging action on at least one rail to hold the slide frame from fore and aft movement relative to the rail.

15 Claims, 5 Drawing Sheets

LOCK CYLINDER FOR BACKHOE SLIDE FRAME

BACKGROUND OF THE INVENTION

The present invention relates to a hydraulic cylinder that has two oppositely acting pistons with differential areas and which can be used for locking two parts that are slidable relative to each other.

Backhoes and excavators that mount onto mobile machines are generally provided with lateral or horizontal rails mounted onto the support machine with a slide frame that slides along these rails from side to side.

A typical backhoe structure that is mounted for side shifting of the type disclosed herein but without the type of locks utilized is illustrated in my own U.S. Pat. No. 4,921,392, which is of general interest for showing the overall mounting arrangement.

It is necessary to have the slide frame locked tightly to the rails so that the slide frame will not tilt or shift during use. Hydraulic lock cylinders have been used for clamping slide frames onto rails, such as the devices shown in U.S. Pat. No. RE 26,439 issued to E. B. Long. There, direct acting hydraulic cylinders will provide compression clamping against the rails.

The prior art also shows wedge-type locking devices which will force the slide frame in one direction to wedge it into locking engagement with support rails. Such a device is shown in U.S. Pat. No. 4,741,663. U.S. Pat. No. 3,405,823 shows a direct acting wedge that can be hydraulically locked into position. In U.S. Pat. No. 3,891,065, hydraulic actuators are positioned between the guide and are expanded to move wedges relative to the rails for locking.

The present invention provides for rapid locking and positive positioning with a relatively simple lock cylinder that is easily mounted and operated.

SUMMARY OF THE INVENTION

The present invention relates to a lock cylinder arrangement for locking members, specifically side shift slide frames of backhoes to the rails on which such slide frames are mounted. A pair of lock cylinders are used. One is positioned on each side of the slide frame and mounted between vertically spaced rails. The cylinders are actuated to lock the frame to these rails by clamping and wedging under hydraulic pressure. The lock cylinders each have at least one piston which acts to clamp and wedge the slide frame relative to the rails. In one embodiment, there are two pistons which act in opposite directions from the opposite ends of the cylinder. The pistons have different effective areas and exert different forces. The slide frame is positively held against one of the rails, with either one or two pistons while the wedge action locks the frame for a stable support.

The use of two lock cylinders, which are horizontally spaced, resists transverse rotational movement of the slide frame on the main frame rails of the backhoe during operation. The pistons are used for providing a positive seating force on one rail and wedges fit between one or both rails of the mounting frame and the slide frame to eliminate any play or movement caused by the gap that is necessary for sliding when the lock cylinders are unlocked. The cylinders provide for a very positive clamping force.

The lock cylinders are arranged in one form of the invention so that there are two nested pistons, with the upper one of the pistons having a larger area, to exert a clamping force and a wedging force on the top rail of the main frame. The smaller, downwardly extending piston effectively exerts only a wedging force on the bottom rail. The larger top piston acting against the upper rail forces the slide frame to seat on the upper edge of the top rail for establishing a positive position to provide stability during operation. The wedging action eliminates fore and aft movement of the slide frame relative to the rails during digging.

The differential area of the oppositely directed pistons also insures vertical clamping and wedging at the top rail and a lower ratio of wedging at the lower rail. However, wedging action is obtained on both rails to provide for a stable seating of the slide frame.

The smaller piston, which acts in direction downward against the lower rail, slides inside the larger piston, so that there is a substantial sliding support surface area for each of the pistons.

A long life, easily operated and easily installed locking system is provided for the slide frames on backhoes.

DETAILED DESCRIPTION OF THE PREFERRED EMBODIMENTS

Figure 1:
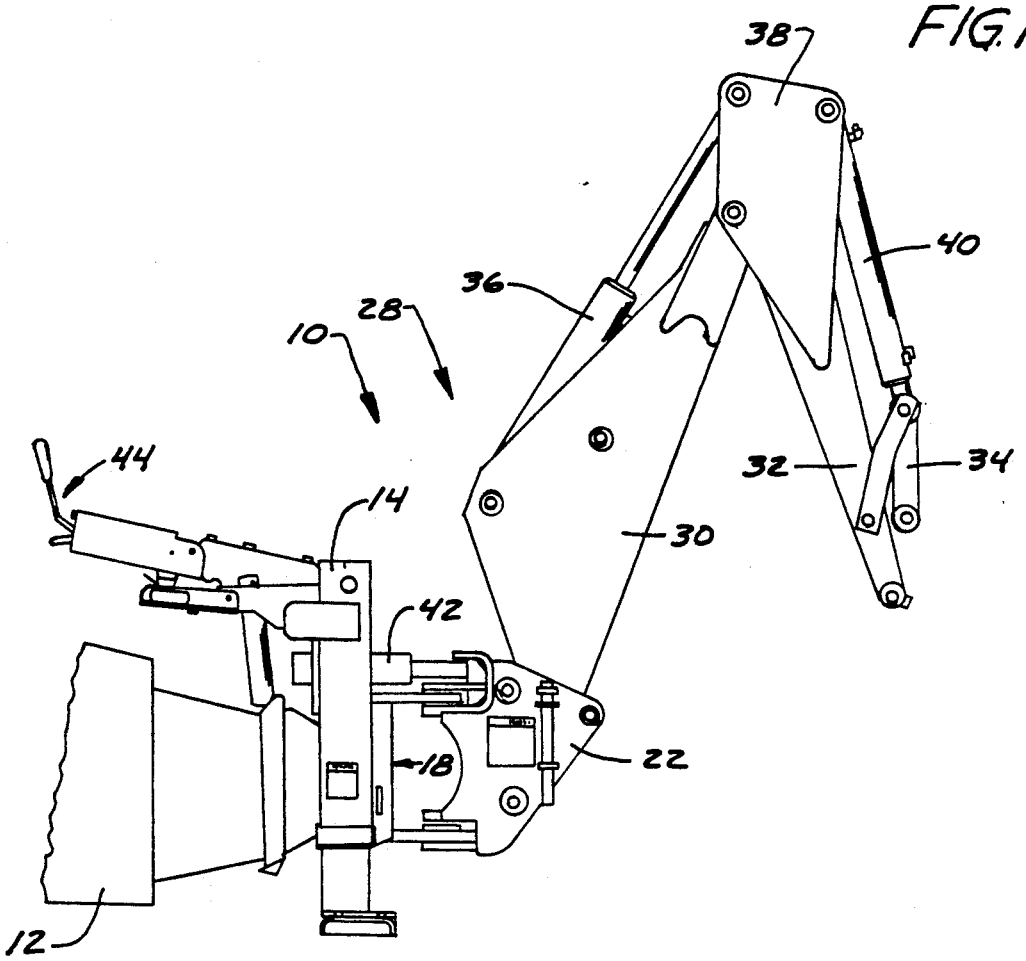
FIG. 1 is a side elevational view of a typical backhoe structure utilizing a locking arrangement of the present invention.
Figure 2:
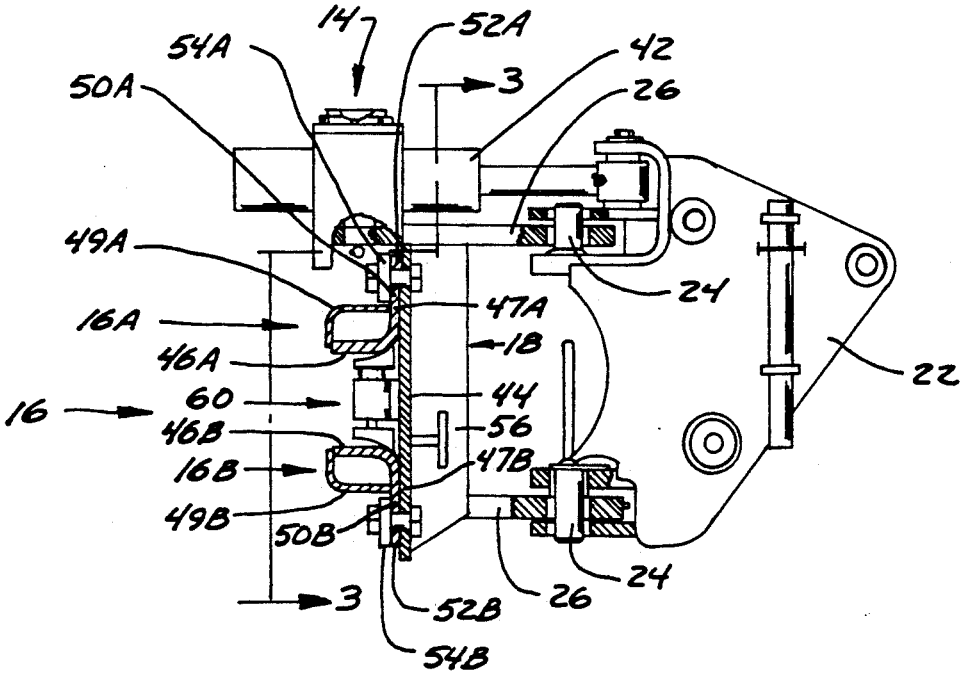
FIG. 2 is a enlarged view of a slide frame and main frame adapted for use with the present invention, with parts in section and parts broken away.
Figure 3:
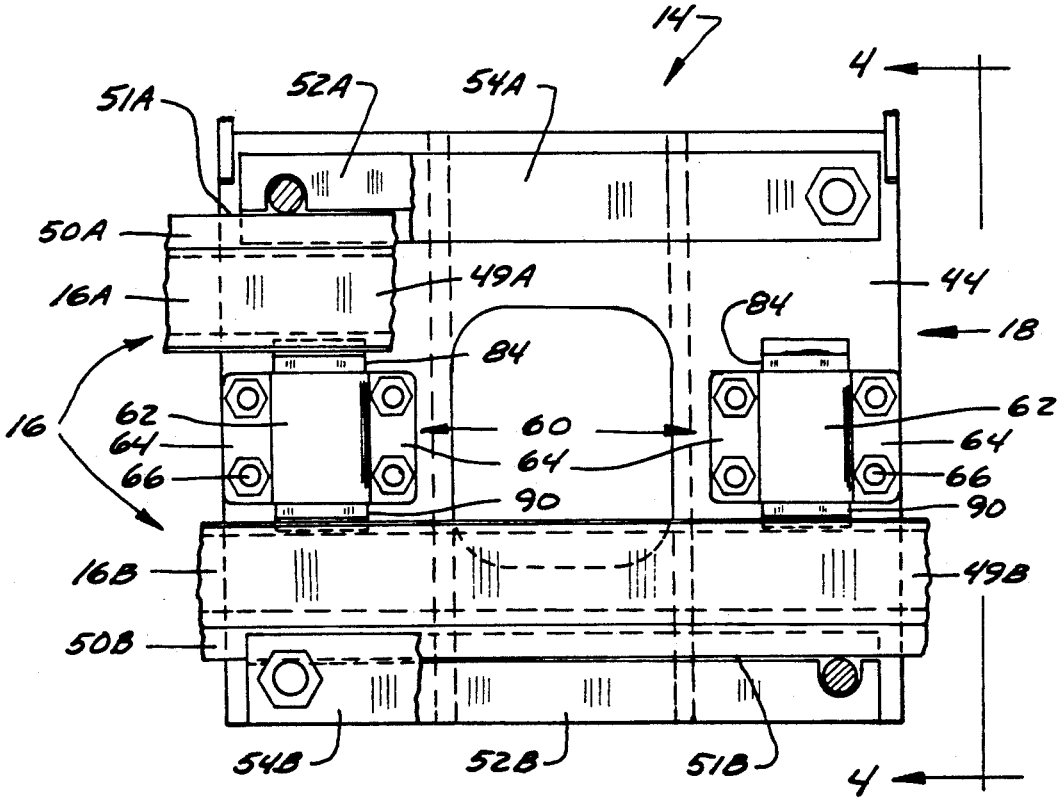
FIG. 3 is a view taken on the line 3—3 in FIG. 2 with the locking cylinders made according to the present invention shown in position with parts in section and parts broken away.

In FIG. 1, a typical backhoe indicated generally at 10 is mounted onto a machine such as a mobile loader indicated schematically at 12 through a main frame assembly 14, that has a pair of generally horizontally extending, vertically spaced rails indicated generally at 16 mounted thereon as shown in FIGS. 2 and 3. In FIG. 2, these rails 16 are shown in cross section. In FIG. 3, these rails 16 are shown extending laterally across the main frame 14. A slide frame 18 is slidably mounted for transverse movement on the rails 16, and the slide frame 18 is locked relative to the rails during use. As shown in FIG. 2, the slide frame 18, in turn, mounts a swing frame 22 on vertical axis pivot pins 24 held on suitable supports 26, so that the swing frame 22 can be moved about a vertical axis from side to side.

In FIG. 1, swing frame 22 mounts boom assembly 28 which includes a boom arm 30, a dipper arm 32, and a bucket mounting linkage 34 for mounting a bucket (not shown) in a conventional manner. A suitable actuator cylinder 36 mounted on boom arm 30 is used for pivoting mounting plates 38 relative to the boom arm 30 for moving the dipper arm 32. A bucket control actuator 40 mounted on plate 38 is provided for actuating the bucket through the linkage 34 in a known manner. The boom arm 30 is pivotally mounted to the swing frame 22, and the swing frame 22 can be operated by suitable hydraulic cylinders indicated at 42 that are mounted to the main frame 14. Operator controls shown generally at 44 are provided on the main frame and are accessible by an operator sitting on the support machine 12.

In FIG. 3, the rails 16 are fragmentarily shown and include a top rail 16A and a lower rail 16B. The slide frame 18 includes a mounting plate 44 which extends in a generally vertical plane, and is of vertical height to span the space between the rails 16A and 16B. The plate 44 forms a main mounting member for the slide frame 18 relative to the rails 16A and 16B.

As can be seen in FIG. 2, the rails 16A and 16B are made of formed sections including formed angle first sections 46A and 46B for the top and bottom rails, respectively, which have legs 47A and 47B that extend vertically. The legs have surfaces that are parallel to the plate 44.

In addition, angle members 49A and 49B of the respective rails are used for closing the rails into a box section (the members 49A and 49B are welded to the respective members 47A and 47B). The box section construction leaves flanges or lips 50A and 50B, respectively, that form support edges which are extensions of the walls 47A and 47B. The lips 50A and 50B have straight upper and lower edges 51A and 51B, respectively, as shown in FIG. 3.

Slide bars indicated at 52A and 52B are welded adjacent the top and bottom of the plate 44. The slide bars overlie the upwardly facing and downwardly facing edges of the lips 50A and 50B, respectively. The upper slide bar 52A will rest on the upper edge 51A of lip 50A. The slide bars 52A and 52B are welded to the plate 44 so they are securely supported and the slide frame is retained on the lips 50A and 50B through the use of lock bars or retainer bars 54A and 54B, respectively, that are bolted to and clamped against the respective slide bars 52A and 52B to provide a recess or pocket for the lips 50A and 50B.

As shown in FIG. 2, the slide bars 52A and 52B are slightly thicker than the lips 50A and 50B to provide for sliding clearance, and the lock or retainer bars 54A and 54B retain slide frame 18 on the rails 16 for sliding movement. The lock bars also clear the members 49A and 49B.

The plate 44 can have suitable upright reinforcements indicated at 56 thereon for supporting the plates 26 that pivotally mount pins 24.

In FIG. 3, the clearance provided by the clamp bars 54A and 54B permits the slide frame 18 to slide along the rails 16A and 16B. The shifting can be done either under power or manually, and when the plate 44 and thus the slide frame and swing frame are in the desired position, the slide frame can be clamped relative to the rails 16A and 16B through the use of lock cylinders 60.

The lock cylinders 60 are on both the right and left hand sides of plate 44, but the same numbers will be used to designate both cylinders. The lock cylinders 60 comprise actuator or cylinder housings 62 that have flanges 64 on the sides thereof. The flanges 64 are bolted with suitable bolts and nuts 66 to the plate 44, and are positioned adjacent the opposite edges of the plates 44. The lock cylinder assemblies 60 are also positioned between the rails 16A and 16B, and thus are above the bottom rail and below the top rail.

Figure 5:
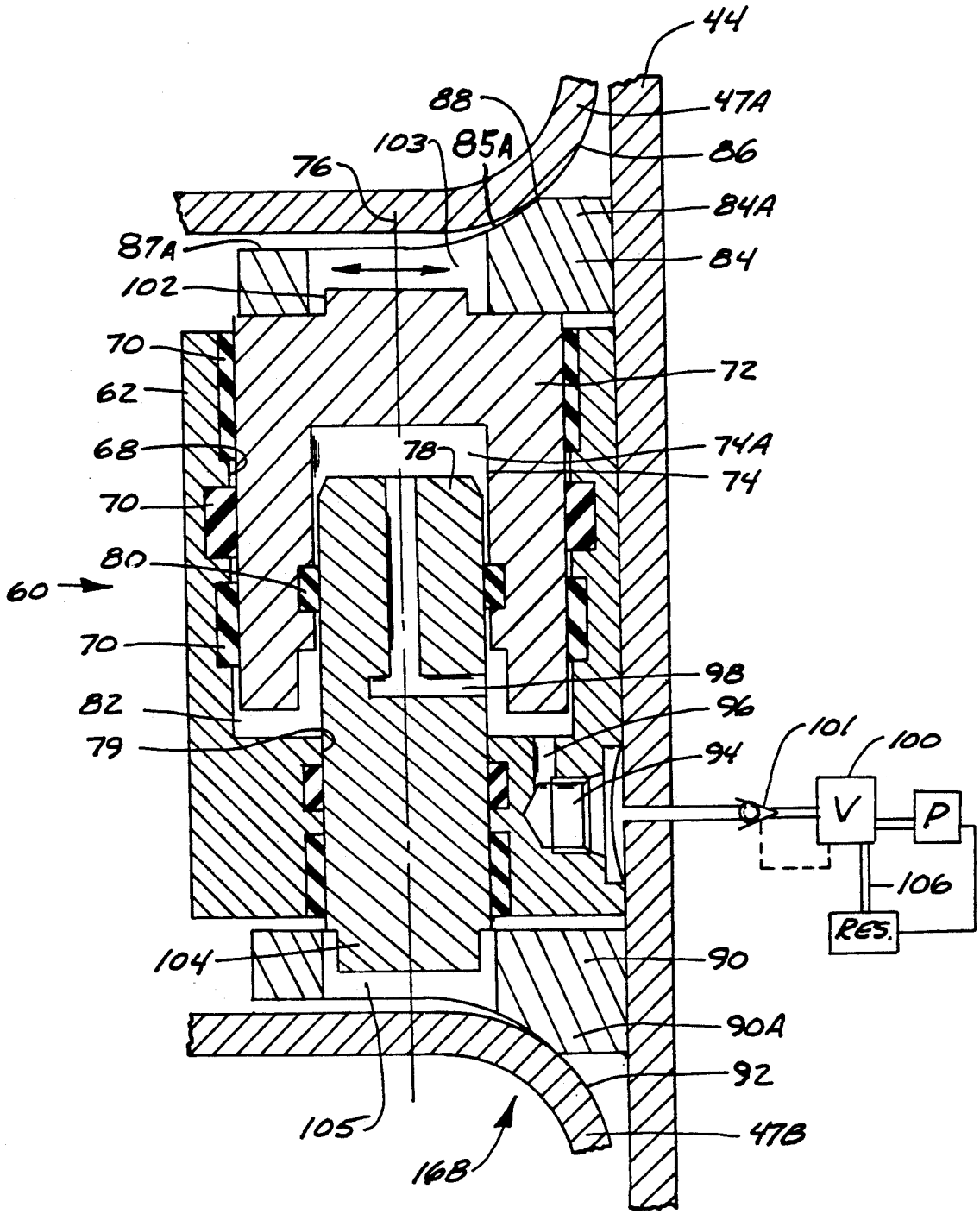
FIG. 5 is a vertical sectional view of a clamping and wedging cylinder made according to the present invention.

Each of the cylinder housings 62 mounts a pair of pistons, as shown in FIG. 5 in cross section in a first form of the invention. The pistons have actuator ends that extend out from opposite ends of the cylinder housings and are made to operate in opposite directions, one upwardly and one downwardly. The pistons are telescopic relative to each other and are constructed so that they have differential active areas. Each cylinder housing 62 has an interior bore 68 with suitable seals generally shown at 70 on the interior for sealing against the cylindrical outer surface of a first piston 72. The first piston 72 extends out the open end of the bore. The first piston 72 has an interior bore 74 that is centered on its central axis shown at 76, and which mounts a second piston 78. The second piston 78 slidably fits into the bore 74 and has a suitable seal 80 for sealing it relative to the surface of the bore. The bore 74 forms an actuator chamber 74A at its inner end, and a chamber 82 which surrounds piston 78 is formed at the lower end of bore 68 and piston 72.

The piston 78 passes through a suitable opening 79 in the lower end of housing 62, which is of smaller diameter than bore 68. The piston 78 is suitably sealed in opening 79 and can be provided with guide bearings, as well. The first piston 72 extends outwardly through an upper end of the housing 62, and as shown, has a clamp-wedge member 84 slidably mounted thereon.

The upper and lower rails 16A and 16B, as previously stated, are formed metal sections, and the angle member 47A has a rounded corner section shown at 86. The wedge 84 is made to have a wedge section or end 84A that will slide up into the gap formed between the plate 44 and the rounded corner section 86. The wedge has a rounded corner 85A that blends to a gently inclined surface 87A. The end 84A and corner 85A are designed to provide adequate clamp (vertical) force as well as horizontal force. The end 84A will be forced up into the gap when the piston 72 is forced upwardly from the housing 62 to provide the horizontal separating force between the plate 44 and the formed angle member 47A, as well as providing a bearing force against the surface of the angle member 47A tending to move the plate 44 downwardly to support it onto edge 51A. This area of contact of the wedge and rail is shown at 88 in FIG. 5.

Figure 4:
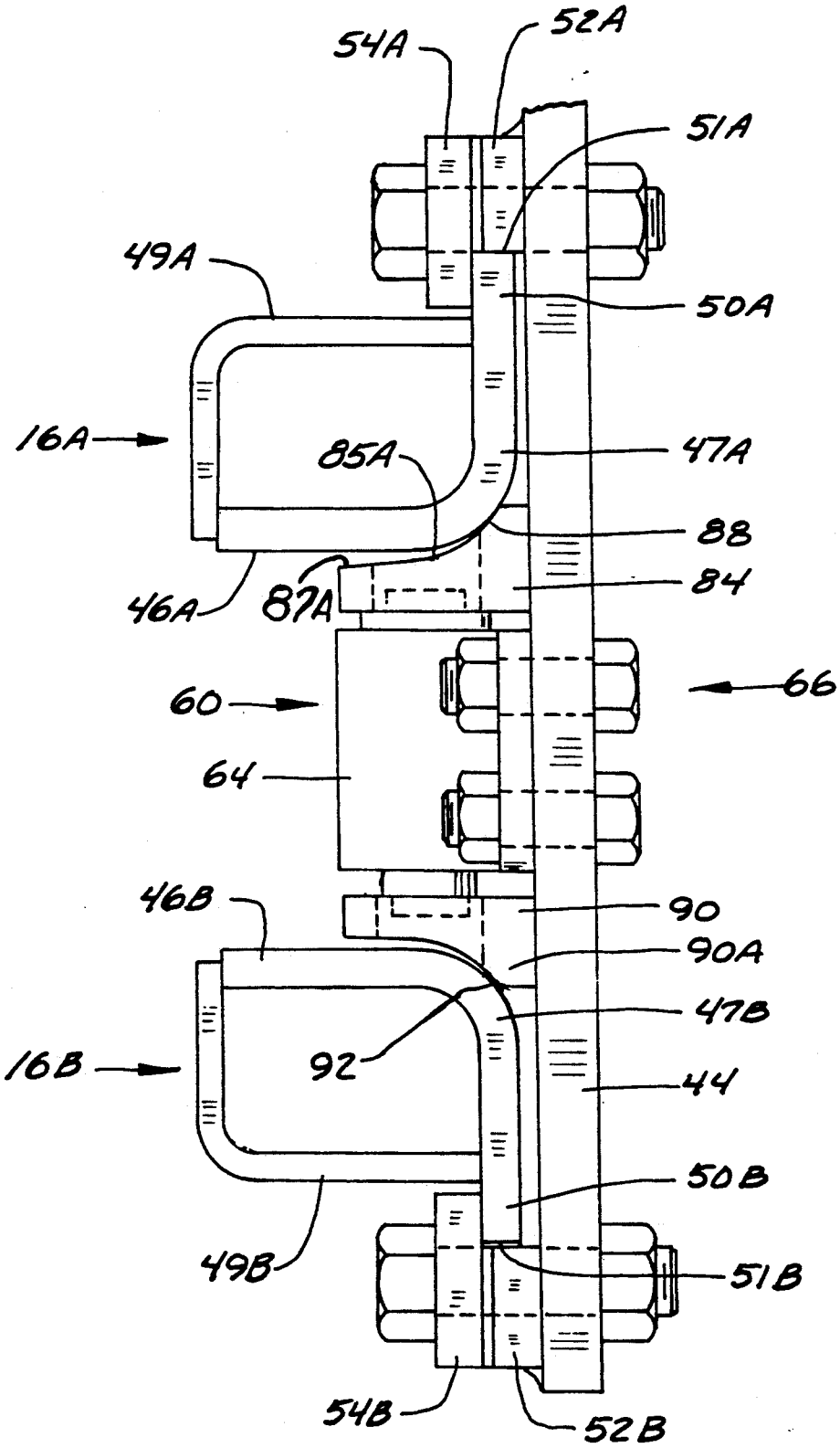
FIG. 4 is a fragmentary end view taken on the line 4—4 in FIG. 3.

The second piston 78 extends outwardly through a bottom end of the housing 62 and has a second wedge 90 mounted thereon. The second wedge 90 is shaped the same as the first wedge 84, and the angle member 47B of rail 16B has a rounded corner 92. The wedge 90 has a section 90A that goes into the space formed by the rounded corner 92 and urges the plate 44 away from the lip 50B as shown in FIG. 4. Both wedges 84 and 90 have flat outer surface portions joining the wedge sections.

The wedges 84 and 90 have slots 103 and 105 formed through the flat main portions into which cylindrical bosses 102 and 104 slidably fit. The bosses retain the wedges for compression loading. The slots 103 and 105 permit the wedges to slide in the direction toward plate 44 as the locking and wedging action occurs to reduce side loading on pistons 72 and 78. Each wedge actually bears against plate 44 as it wedges plate 44 and the respective rail apart.

In FIG. 5, hydraulic oil under pressure is introduced from a valve 100 through a port 94, and through a suitable passageway 96 into the chamber 82 when the cylinders are to be locked. As can be seen, the second piston 78 has an internal passageway 98 that opens to chamber 82 and also extends upwardly to open into chamber 74A. When valve 100 is operated, the hydraulic fluid under pressure passes through a check valve 101 and will tend to separate the two pistons because of pressure acting on the downwardly facing surface areas of the first piston 72, including the bottom of the recess 74, and the same hydraulic pressure will be acting on the upper surface of the piston 78, within the chamber 74A. That means that there is a differential piston area, and that the force acting upwardly against the upper rail 16A will be greater than the force acting downwardly against the rail 16B. The wedge 90 will be urged toward the rail 16B with lesser force than acting against the rail 16A.

The differential area of the pistons causes the slide frame to seat against one of the rails. The use of two telescoping pistons, as shown, permits greater stability for each of the pistons, because of the long sliding interface between the pistons, as well as relative to the bore in the housing 62.

The lock cylinders 60 can be used for differential clamping forces in other applications, such as retaining parts onto mounting members, including mounting buckets onto loaders or the like.

As can be seen in FIG. 4, the slide bar 52A will be forced down against the upper edge 51A of the lip 50A for a positive seating on the upper edge 51A of the lip 50A to insure that there is stable seating of the slide frame on the rail 16A. The horizontally spaced lock cylinders 60 resist rotational movement about a generally horizontal axis during use. However, both of the pistons 72 and 78 shown in FIG. 5 will exert a wedging force that will tend to move the plate 44 away from the respective lip 50A or 50B as shown in FIG. 4 and will urge the clamp or lock plates 54A and 54B against the sides of the lips to provide a positive positioning against movement in front and rear directions. The wedging is in two vertically spaced locations on each end of the frame for stability about a lateral axis as well. The clamp bars 54A and 54B can be shimmed outwardly relative to the slide bars 52A and 52B in order to provide adequate and proper clearance for the lips 50A and 50B.

A check valve 101 in the pressure as shown in FIG. 5 will retain the lock cylinders under pressure during use when the slide frame 18 in FIG. 2 is to be stationary. The valve 100 can be operated to release the check valve and release pressure on the two pistons on each of the lock cylinders 60 shown in FIG. 3 to a return line 106. Then the slide frame will be loosened. The valve 100 is a commercially available 3-way valve with a built-in check valve.

The upper piston 72 exerts clamping force that forces the slide bar 52A downwardly against the edge 51A of the lip 50A as shown in FIG. 4, and it also exerts a wedging force that urges the plate 44 away from the lip 50A to provide a wedging action so that the lock bar 54A is clamped securely to prevent fore and aft movement.

Figure 6:
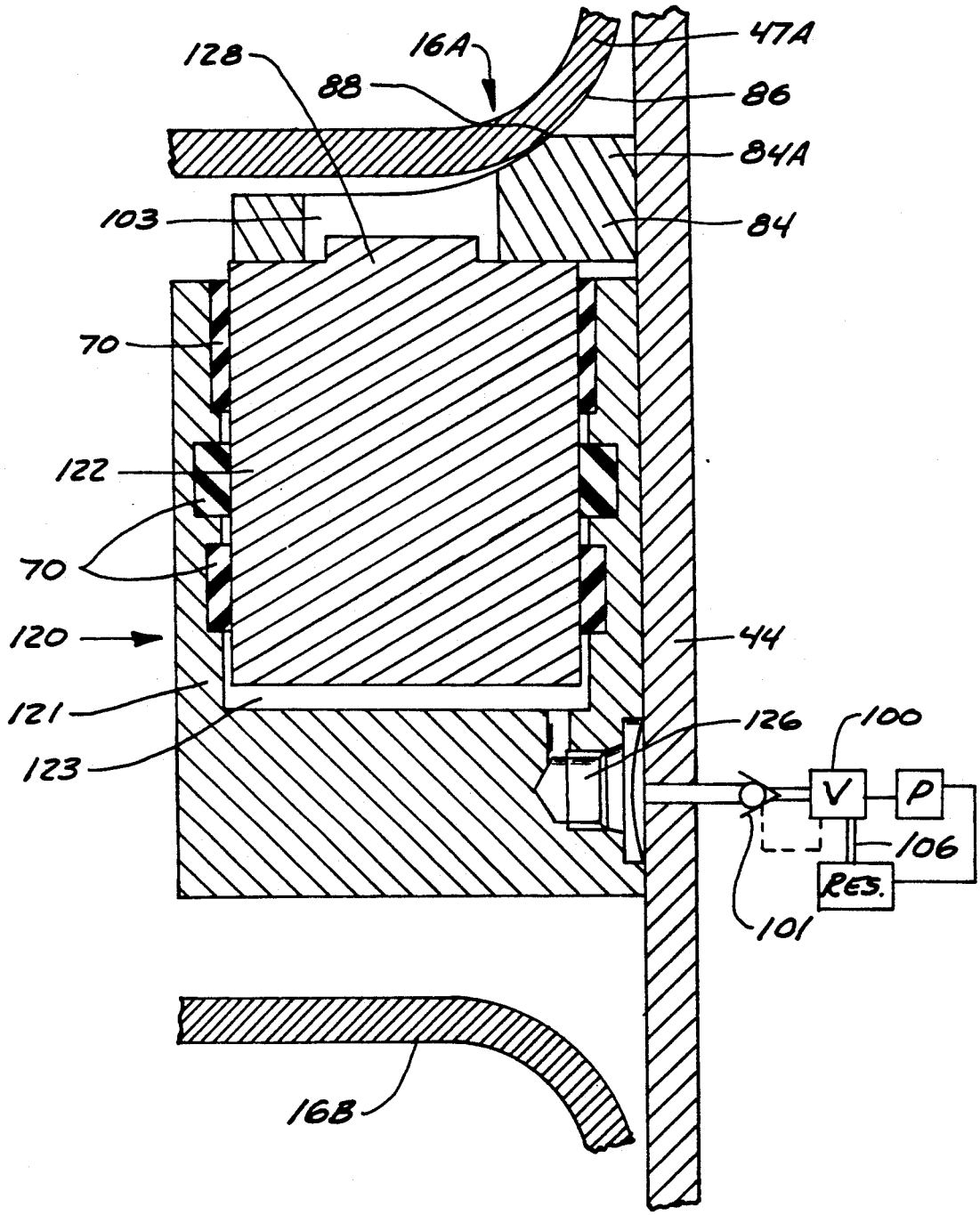
FIG. 6 is a sectional view taken on the same line as FIG. 5 showing a modified clamping and wedge cylinder acting against the top rail only.

In a modified form of the invention, shown in FIG. 6, a modified actuator or cylinder 120 is utilized. This actuator includes a housing 121, that is mounted onto the plate 44 in the same manner as previously explained. The housing 121 has a single larger diameter piston 122 mounted in an interior chamber 123. The lower end of the housing 121 is closed, except for hydraulic fluid inlet port 126. The hydraulic circuit for actuating the cylinder can be the same as that previously explained and as is shown in FIG. 6.

The piston 122 has a boss 128 that mounts in slot 103 of wedge 84, (the wedge can be the same as that shown in the previous form of the invention) and the lower rail 16B is not acted on by a wedge. When the lock cylinder or actuator 120 is operated in this form of the invention, the wedge 84 is forced upwardly by the piston 122, with hydraulic fluid under pressure provided to chamber 123, and the wedge bears against the upper rail and locks the plate 44 downwardly against the lip 50A as previously explained. The wedge also urges the plate 44 away from the rail portion 47A to lock the slide frame relative to the rail.

The lower rail is used for guiding the slide frame, but it is not positively locked with a separate actuator.

The lock cylinders can be plumbed in parallel, so that they carry the same pressure.

When the cylinders 60 are used and are locked, small piston 78 will extend and will cause wedge 90 to make contact with the bottom rail 16B and plate 44 to provide wedging action, and the larger piston 72 will extend and will cause wedge 84 to wedge and clamp in contact at the bottom side of the top rail 16A. The large piston, because of its larger effective area, will overpower the small piston and will cause the plate 44 to move downwardly so that the upper edge 51A of the lip 50A is contacted by the edge of slide bar 52A for clamping as shown in FIG. 4. The wedges 84 and 90 will displace the plate 44 to tighten up the designed gap between the rails and the slide frame. The final result is that the larger piston 72 clamps and wedges against the upper rail 16A, and the bottom piston 78 acts to wedge the plate tightly against lip 50B.

In the second form of the invention the piston 122 forces the wedge 84 upwardly while moving plate 44 downwardly to provide positive support.

Although the present invention has been described with reference to preferred embodiments, workers skilled in the art will recognize that changes may be made in form and detail without departing from the spirit and scope of the invention.

What is claimed is:

1. A machine having a slide frame slidably carried on at least one slide rail mounted on a support to define a plane of movement of the slide frame and a second rail spaced from the slide rail and generally parallel thereto, the slide frame having a fluid pressure locking cylinder assembly for exerting locking forces in two opposite directions along an axis, and comprising:

a cylinder housing carried by the slide frame to lock the slide frame into a desired position along the at least one slide rail wherein said at least one slide rail comprises a transversely extending lip, the lip on the rail having a narrow upper edge comprising an upper surface, and a second surface parallel to the plane of movement of the slide frame, support means on the slide frame slidably engaging the upper surface of the one slide rail for movement along the slide rail and for preventing separation of the slide frame from the slide rail in a direction perpendicular to the plane of sliding movement along the rail and wherein the slide rail comprises a channel like member having a stop wall on the opposite side of the lip from the slide frame;

a piston assembly within a bore in said cylinder housing, said piston assembly including a first piston fitted within the bore in the housing and mounted to extend outwardly through a first end of said housing, said first piston remaining partially within the housing, and a second piston slidably mounted in a bore in said first piston and extending outwardly from the housing in an opposite direction from the first piston, said second piston remaining partially within the housing, said second piston having an effective area that is less than the first piston, and means to provide fluid pressure to exert the same pressure on the first piston within the housing bore and the second piston within the bore in the first piston to provide a differential force in opposite directions from said housing, at least one of the first or second piston assemblies having wedge means to engage the slide rail and the other of the first and second pistons engaging the second rail, said wedge urging the stop wall against the lip when the wedge is under force from the lock cylinder; and said locking cylinder assembly pistons exerting a force on the wedge means when the locking cylinder assembly is under fluid pressure to force the wedge means toward the slide rail and second rail and between the second surface of the slide rail and the slide frame to exert forces urging the support means against the upper surface of the slide rail and urging the slide frame away from the second surface and also urging the slide frame away from the second rail under forces exerted by the pistons.

2. The machine of claim 1 wherein said at least one slide rail comprises a formed rail section having a rounded corner facing the lock cylinder and joining a wall having the second surface, said wedge means being aligned with the rounded corner and bearing against the slide rail at such corner.

3. The machine as specified in claim 1 wherein there are two laterally spaced lock cylinders mounted on the slide frame, each operating a separate wedge means to provide a wedge and lock action at two spaced positions along the at least one slide rail for transverse stability.

4. The machine of claim 1 wherein said second piston comprises a rod member of substantially uniform diameter throughout its length, said diameter being less than that of the first piston.

5. A machine having a slide frame slidably carried on a slide rail to define a plane of movement of the slide frame and comprising:

at least one slide rail wherein each provided slide rail comprises a formed rail section having a rounded corner joining a first wall that is parallel to a portion of the slide frame and a second wall parallel to the plane of sliding movement of the slide frame;

a hydraulic locking means carried by the slide frame to hydraulically lock the slide frame into a desired position along the at least one slide rail, the first wall of the one slide rail having a first upwardly facing surface and a second surface parallel to the plane of movement of the slide frame, support means on the slide frame slidably engaging the upper surface of the first wall for movement along the one slide rail and having a portion hooked over the one slide rail first wall for preventing separation of the slide frame from the one slide rail in a direction perpendicular to the plane of sliding movement along the one slide rail, and at least one fluid pressure actuated lock cylinder carried by the slide frame and having wedge means at least one end thereof movable toward the one slide rail; and said locking cylinder assembly having piston means for exerting a force on the wedge means when the lock cylinder is under fluid pressure to force the wedge means toward the one slide rail toward the rounded corner and between the second surface of the first wall of the one slide rail and the slide frame to exert forces urging the support means against the upper surface of the first wall of the one slide rail and urging the slide frame away from the second surface of the one wall.

6. The machine of claim 5 wherein the wedge means is supported on an outwardly extending end of the piston means on a support surface generally perpendicular to the direction of movement of the piston means and a slotted coupling between the wedge means and the piston means to permit limited sliding movement of the wedge means along the support surface as the wedge means engages the one support rail.

7. The apparatus of claim 5 wherein there is an upper slide rail and a lower slide rail and wherein the upper slide rail being the one slide rail and the first wall of the lower slide rail having a first downwardly facing surface and a second surface parallel to the plane of movement of the slide frame, said lock cylinder includes a pair of pistons mounted in a housing, a first piston being slidably mounted in the housing and having the first mentioned wedge means thereon, and a second piston slidably mounted in a recess in the first piston and sealed relative to the recess, the pistons extending out of the housing in opposite directions, respectively, the second piston having second wedge means thereon and means for providing hydraulic fluid under pressure to the interior of the housing and to the recess in the first piston to exert forces tending to separate the first and second pistons and move the pistons outwardly from the housing in opposite directions, the second wedge means engaging the rounded corner of the lower rail.

8. The machine of claim 7 wherein the first walls of the upper and lower rails comprise transversely extending lips, the lip on the upper rail having an upper edge comprising the upwardly facing surface and the lip in the lower rail comprising a downwardly facing surface and the portion hooked over the first walls for preventing separation of the slide frame and the rails comprising a channel-like member having a stop wall on the opposite side of each of the lips from the slide frame, said wedges urging the stop walls against the lips when the wedges are under force from the lock cylinder.

9. The apparatus as specified in claim 8 wherein each lock cylinder first piston acts against the upper rail and urges the channel-shaped member downwardly against the upper edge of the lip of the upper rail.

10. The apparatus as specified in claim 6 wherein there are two laterally spaced lock cylinders mounted between the rails, to provide a locking action at two spaced positions along the rails.

11. A machine having a slide frame slidably carried on a slide rail to define a plane of movement of the slide frame and comprising:

at least one slide rail wherein the at least one slide rail comprises a formed rail section having a rounded outer corner surface, said one slide rail also comprising a transversely extending lip;

a pair of laterally spaced hydraulic locking means carried by the slide frame to hydraulically lock the slide frame into a desired position along the one slide rail, said one slide rail having a first upwardly facing surface on the lip and a second surface parallel to the plane of movement of the slide frame, support means on the slide frame slidably engaging the upper surface of the one rail for movement along the rail and having a portion hooked over the lip for preventing separation of the slide frame from the one rail in a direction perpendicular to the plane of sliding movement along the rail, said lock cylinders being positioned below the one slide rail, said lock cylinders having wedge means at least one end thereof to engage the one slide rail; and said locking cylinders having piston means for exerting a force on the wedge means when the lock cylinders are under fluid pressure to force the wedge means toward the rounded outer corner surface of the at least one slide rail and between the second surface of the one rail and the slide frame to exert forces urging the support means against the upper surface of the rail and urging the slide frame away from the second surface, the portion of the support means hooked over the lip reacting against the force urging the slide frame away from the second surface.

12. The machine as in claim 11 wherein there is an upper slide rail and a lower slide rail with lips with surfaces extending in opposite directions.

13. The machine as in claim 12 wherein the pair of lock cylinders is positioned below the upper slide rail and above the lower slide rail.

14. The machine of claim 13 wherein said lock cylinders include a pair of pistons mounted in a housing, a first piston being slidably mounted in the housing, and a second piston slidably mounted in a recess in the first piston and sealed relative to the recess, the pistons extending out of the housing in opposite direction, respectively, and means for providing hydraulic fluid under pressure to the interior of the housing and to the recess in the first piston to exert forces tending to separate the first and second pistons and move the pistons outwardly from the housing in opposite directions.

15. The machine of claim 12 wherein said transversely extending lip comprises a narrow upper edge comprising the upper surface, and the support means for preventing separation of the slide frame wherein the support means comprises a channel-like member having a stop wall on the opposite side of the lip from the slide frame, said wedge urging the stop wall against the lip when the wedge is under force from the lock cylinders.

* * * * *